US011492164B2

(12) United States Patent
Palese et al.

(10) Patent No.: US 11,492,164 B2
(45) Date of Patent: Nov. 8, 2022

(54) LIQUID CAPTURE APPARATUS FOR USE WITH A VACUUM SEALER

(71) Applicant: Blue Sky Innovation Group, Inc., Sheffield Village, OH (US)

(72) Inventors: Jeffrey W. Palese, N. Ridgeville, OH (US); Glenn Baker, Seven Hills, OH (US); Konstantin Nakovksi, Bedford Hts., OH (US); Thaddeus T. Brej, Rocky River, OH (US)

(73) Assignee: BLUE SKY INNOVATION GROUP, INC., Avon, OH (US)

( * ) Notice: Subject to any disclaimer, the term of this patent is extended or adjusted under 35 U.S.C. 154(b) by 322 days.

(21) Appl. No.: 16/583,463

(22) Filed: Sep. 26, 2019

(65) Prior Publication Data

US 2020/0039674 A1 Feb. 6, 2020

Related U.S. Application Data

(62) Division of application No. 15/267,230, filed on Sep. 16, 2016, now abandoned.

(51) Int. Cl.
*B65B 65/00* (2006.01)
*B65B 31/04* (2006.01)
(Continued)

(52) U.S. Cl.
CPC ..... *B65B 65/00* (2013.01); *B65B 7/02* (2013.01); *B65B 31/024* (2013.01);
(Continued)

(58) Field of Classification Search
CPC ..... B65B 65/00; B65B 7/02; B65B 31/024; B65B 31/048; B65B 31/04; B65B 31/043; B65B 31/06; B65B 51/10; B65B 51/146; B65B 61/20; B01D 5/0072; B01D 5/009; B65D 81/203; B65D 81/26; B65D 81/261; B65D 81/264
(Continued)

(56) References Cited

U.S. PATENT DOCUMENTS 2,216,330 A * 10/1940 Stover ..... B65D 81/3893 62/372
3,580,125 A * 5/1971 Heatwole ..... G10D 7/14 84/377

(Continued)

*Primary Examiner* — Dariush Seif
(74) *Attorney, Agent, or Firm* — Tarolli, Sundheim, Covell & Tummino LLP

(57) ABSTRACT

An apparatus collects liquid in a vacuum bag for vacuum packaging a product, such as a food product, wherein a vacuum is drawn in the vacuum bag by a vacuum sealer, which also seals the vacuum bag after the vacuum is formed. The liquid collecting apparatus includes a housing configured to be placed in the vacuum bag between the product and an open end of the bag that is configured to be received in the vacuum sealer. The housing includes a side wall defining an interior space and at least one opening that extends through the side wall. The at least one opening is configured so that air drawn out of the vacuum bag can pass through the housing via the at least one opening and exit the vacuum bag through the open end, and liquid can enter the interior of the housing, but is prevented from escaping and thereby captured.

17 Claims, 8 Drawing Sheets

(51) Int. Cl.

| | |
|---|---|
| ***B65B 61/20*** | (2006.01) |
| ***B65B 51/14*** | (2006.01) |
| ***B65B 7/02*** | (2006.01) |
| ***B65B 31/02*** | (2006.01) |
| ***B65B 51/10*** | (2006.01) |

(52) U.S. Cl.
CPC ..... *B65B 31/048* (2013.01); *B65B 51/10* (2013.01); *B65B 51/146* (2013.01); *B65B 61/20* (2013.01)

(58) Field of Classification Search
USPC ..... 53/512, 432, 434
See application file for complete search history.

(56) References Cited

U.S. PATENT DOCUMENTS 5,287,960 A * 2/1994 Kalb ..... A61F 15/001 206/210
5,660,868 A * 8/1997 Yeager ..... B65D 81/264 206/204
5,839,572 A * 11/1998 Yeager ..... B65D 31/12 206/204
6,447,826 B1 * 9/2002 Matthews ..... A23B 4/16 426/126
6,969,024 B2 * 11/2005 He ..... A47K 10/40 239/52
7,799,361 B2 * 9/2010 Etchells ..... A23L 3/3436 426/426
8,727,111 B2 * 5/2014 Schlegel ..... B65D 81/264 426/119
2002/0175218 A1 * 11/2002 Uranaka ..... A23L 3/3508 239/56
2005/0098465 A1 * 5/2005 Wolf ..... A61L 9/12 206/410
2006/0016744 A1 * 1/2006 Miner ..... E21B 43/084 210/416.1
2009/0020483 A1 * 1/2009 Davis ..... B01D 33/23 210/784
2009/0145783 A1 * 6/2009 Forker ..... B65D 81/268 206/204
2010/0059358 A1 * 3/2010 Ritchey ..... B01D 5/0051 203/10
2010/0180548 A1 * 7/2010 Binger ..... B65D 81/2038 53/434
2010/0255162 A1 * 10/2010 Becraft ..... B65D 81/2076 426/264
2011/0158563 A1 * 6/2011 Soletski ..... B65D 31/10 383/105
2011/0197933 A1 * 8/2011 Yoon ..... A47L 15/4206 134/110
2013/0001106 A1 * 1/2013 Schlegel ..... B65D 75/30 206/204
2014/0061111 A1 * 3/2014 Pavel ..... B01D 24/16 210/232
2014/0199001 A1 * 7/2014 Haluck ..... B65D 81/261 383/109
2014/0272021 A1 * 9/2014 McKedy ..... A23L 3/349 426/124
2018/0079544 A1 * 3/2018 Palese ..... B65B 7/02

* cited by examiner

LIQUID CAPTURE APPARATUS FOR USE WITH A VACUUM SEALER

RELATED APPLICATION

This application is a divisional of U.S. application Ser. No. 15/267,230, filed on Sep. 16, 2016, the disclosure of which is hereby incorporated by reference in its entirety.

TECHNICAL FIELD

This invention relates to a vacuum sealer for vacuum packaging food products in a vacuum package, such as a plastic vacuum bag. More specifically, this invention relates to a device for use with a vacuum sealer that captures liquid and prevents it from entering the mouth of the vacuum bag during the vacuum sealing process.

BACKGROUND OF THE INVENTION

Vacuum sealers are electric appliances used to vacuum pack food products, such as meats, fruits, vegetables. The food products are placed in a specially designed plastic vacuum bag and the open end of the bag is placed in a vacuum sealer. The vacuum sealer removes the air in the bag, creating a vacuum that draws the bag around and onto the food product. Air can also be drawn from within the food product itself. Once the vacuum is formed in the bag, the vacuum sealer seals closed the open end of the bag, typically using a combination of heat and pressure.

When vacuum sealing food products, the evacuation of the gasses (e.g., air) in the bag results in the food product being compressed in the bag as the bag is drawn against the food. As a result, when vacuum sealing food products with a high liquid/moisture content, liquid can be removed from the food product and drawn through the mouth or opening of the vacuum sealing bag. This can be problematic, since the presence of moisture between the plies of the bag can prevent or inhibit the bag from sealing properly. This is because the liquid prevents the formation of the bond realized though the application of heat and pressure applied to the bag by the vacuum sealer.

SUMMARY OF THE INVENTION

The invention provides a solution to a known problem in vacuum sealing wherein liquids drawn through the open end of the vacuum bag can prevent or inhibit an effective sealing of the bag.

According to one aspect, an apparatus collects liquid in a vacuum bag for vacuum packaging a product, such as a food product, wherein a vacuum is drawn in the vacuum bag by a vacuum sealer, which also seals the vacuum bag after the vacuum is formed. The liquid collecting apparatus includes a structure configured to be placed in the vacuum bag between the product and an open end of the bag that is configured to be received in the vacuum sealer. The structure defines an interior space and includes at least one opening that extends through the structure and provides fluid communication between the interior space and the environment outside the structure. The at least one opening is configured so that air drawn out of the vacuum bag can pass through the structure via the at least one opening and exit the vacuum bag through the open end. Liquid can enter the interior of the structure, but is prevented from escaping and thereby is captured.

According to another aspect, the structure can have an elongated configuration with a length selected to correspond to the width of the vacuum bag. The structure can have an elongated configuration and can be further configured to have a length that can be adjusted.

According to another aspect, the structure can include a housing including a side wall that defines the interior space. The at least one opening extends through the side wall, and liquid entering the interior of the housing is captured within the housing. The housing can include first and second housing parts connected to each other in a telescoping relationship so that the length of the housing can be adjusted. The housing can have a generally flattened oval or oblong cross-sectional configuration, or a generally circular cross-sectional configuration.

According to another aspect, the housing can include a cylindrical side wall and the at least one opening comprises a plurality of slots that extend circumferentially about the side wall.

According to another aspect, the housing can include elongated upper and lower wall portions and side wall portions extending between the upper and lower wall portions. The at least one opening can extend through the side walls. The upper and lower wall portions can be configured to be positioned adjacent opposite plies of the vacuum bag, a first one of the side walls is configured to be positioned proximate the product in the vacuum bag, and the other one of the side walls is configured to be positioned proximate the open end of the vacuum bag.

According to another aspect, the at least one opening can include a plurality of slots arranged parallel to each other along the length of the housing.

According to another aspect, the structure can include a plurality of bellow joints arranged adjacent to each other to form a side wall extending along the length of the structure. The side wall can define an interior space. The at least one opening can extend through the side wall, and liquid entering the interior space through the openings in the side wall is captured within the interior.

According to another aspect, each bellow joint can have an expanded condition and a contracted condition. The length of the side wall can be the adjusted by adjusting the expanded and contracted conditions of the bellow joints. The bellow joints can be deformable to allow the sidewall to be bent to give the structure a curved configuration.

According to another aspect, the structure can include a helical coil comprising a plurality of coil turns extending along the length of the structure and defining an interior space. The at least one opening can include space between the coil turns that allow liquid to enter and be captured within the interior space. The length of the structure can be adjusted by stretching the helical coil. The coil turns can be deformable to allow the helical coil to be bent to give the structure a curved configuration. The coil can include a helical element that is one of round and rectangular in cross-section.

According to another aspect, the apparatus can be implemented in a system including a vacuum sealer.

According to another aspect, an apparatus for collecting liquid in a vacuum bag for vacuum packaging a product, such as a food product, wherein a vacuum is drawn in the vacuum bag by a vacuum sealer, which also seals the vacuum bag after the vacuum is formed, includes a structure configured to be placed in the vacuum bag between the product and an open end of the bag that is configured to be received in the vacuum sealer. The structure defines an interior space and at least one opening extending through the structure and providing fluid communication between the interior space and the environment outside the structure. The structure is configured such that the vacuum bag is drawn against an exterior of the structure as the vacuum is drawn into the vacuum bag. The structure is configured to have a rigidity sufficient to maintain the interior space despite the pressure created by the vacuum. The interior space is configured to collect the liquid that enters through the at least one opening and retain the liquid in the interior space until filled.

BRIEF DESCRIPTION OF THE DRAWINGS

For a better understanding of the invention, reference may be made to the accompanying drawings.

DESCRIPTION OF EMBODIMENTS

Figure 1A:
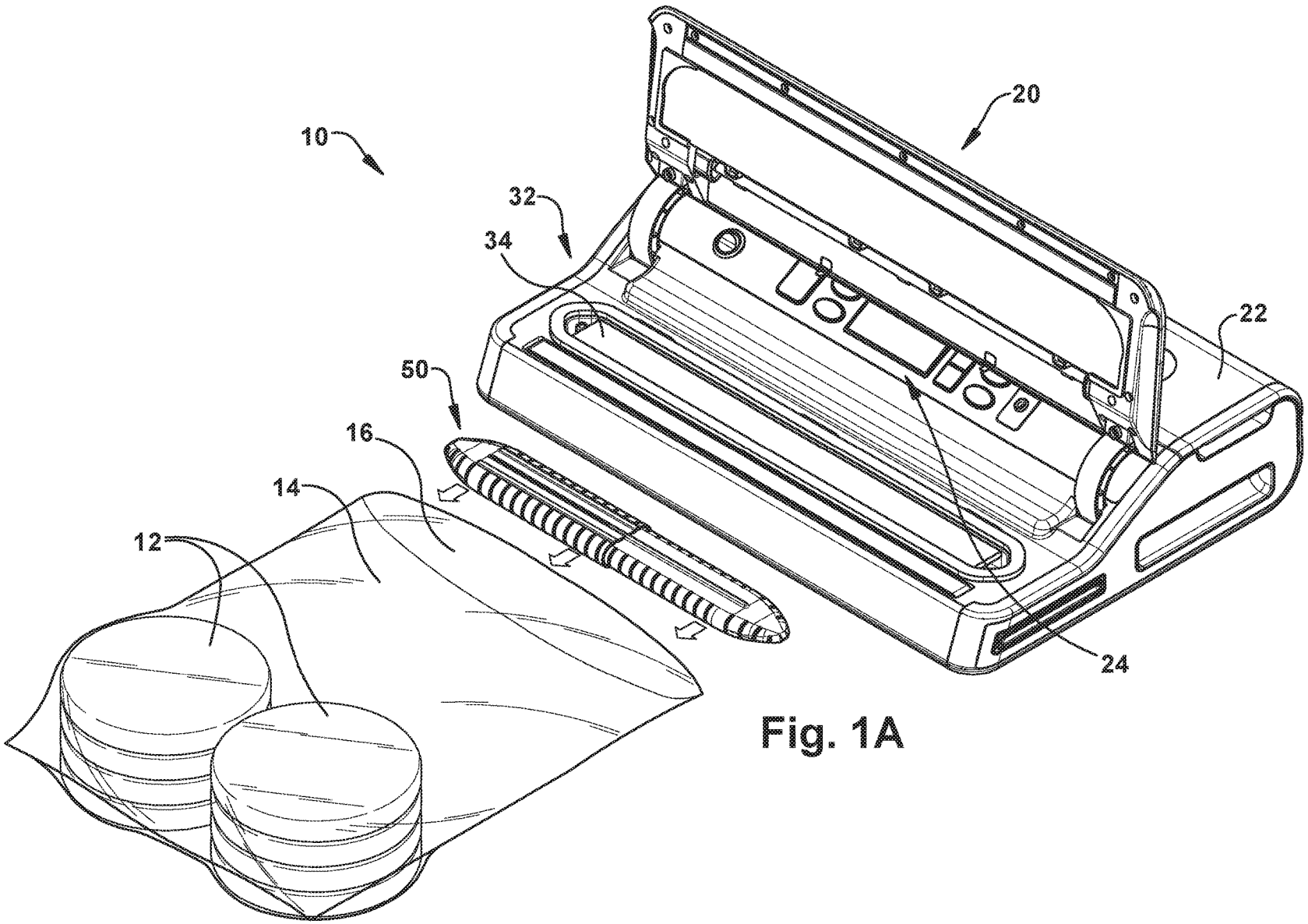
FIG. 1A is a perspective view illustrating a vacuum packaging system including liquid capture apparatus for use with a vacuum sealer according to a first example embodiment, in which the system is illustrated in a first condition.
Figure 1B:
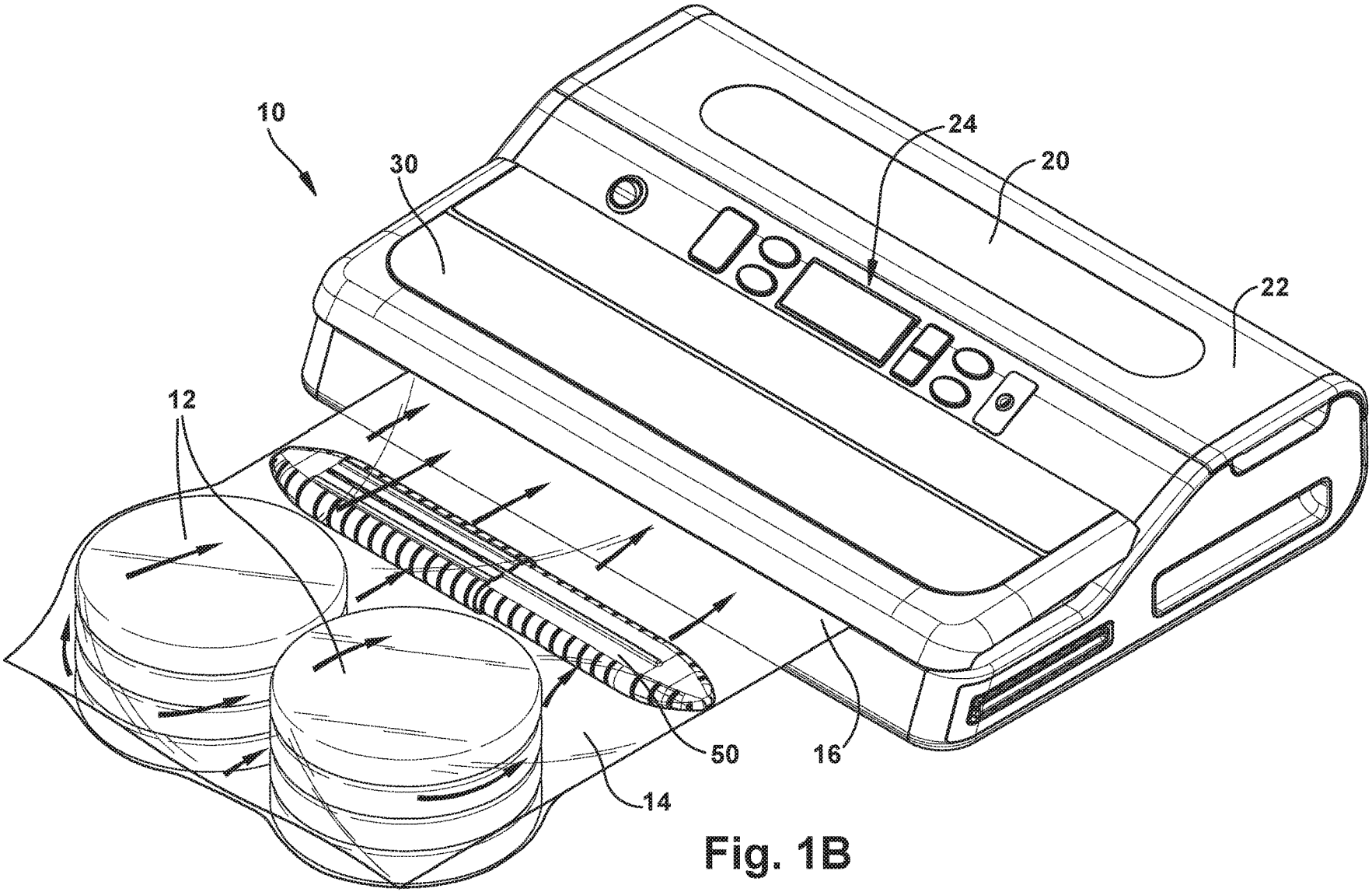
FIG. 1B is a perspective view illustrating the vacuum packaging system of FIG. 1A, in which the system is illustrated in a second condition.

Referring to FIGS. 1A and 1B, a system 10 for vacuum sealing a food product 12 in a vacuum package or bag 14 (e.g., a plastic bag) includes a vacuum sealer 20 and a liquid capture device or apparatus 50. Vacuum sealers 20 are known in the art and come in various sizes and configurations. A typical vacuum sealer 20 includes a housing 22 that houses vacuum forming components (not shown), such as vacuum pumps, and bag sealing devices, such as heating elements. The housing 22 also supports the electronics and control circuitry, as well as a user interface 24, which can include switches, buttons, knobs, a display screen, etc.

The vacuum sealer also includes a lid 30 that has an opened condition (FIG. 1A) and a closed condition (FIG. 1B). The lid 30 covers a bag receiving compartment 32 that receives the open end 16 of the vacuum bag 14. The compartment 32 includes or contains an intake or inlet (not shown) through which the vacuum pumps draw air. The compartment 32 also includes or contains a bag sealer 34, such as a heating element. When the lid 30 is closed, it clamps onto the open end 16 of the vacuum bag 14, placing the interior of the bag in fluid communication with the vacuum pump inlet. In the closed condition of the lid 30, the end portion 16 of the vacuum bag 14 is positioned adjacent or against the bag sealer 34.

Referring to FIG. 1B, when the vacuum bag 14 is positioned in the vacuum sealer 20 with the lid 30 closed, the sealer is activated and operated via the user interface 24. The vacuum pump(s) are activated and air is drawn out of the vacuum bag 14, as indicated generally by the arrows in FIG. 1B. This causes the vacuum bag 14 to draw in around the food product 12, forming a tight package. Further operation of the vacuum pump causes the removal of more and more air from the package until a vacuum is formed in the vacuum bag 14. Once the desired degree of vacuum is achieved, the bag sealer 34 is activated and the open end 16 of the vacuum bag 14 is sealed closed, which maintains the vacuum inside the bag. The lid 30 is opened, and the vacuum packaged food product 12 is removed from the vacuum sealer, ready for storage.

During operation of the vacuum sealer 20, as air is drawn out of the vacuum bag 14 and the bag begins to compress around the food product 12, the food product can become squeezed by the bag, which can draw liquid or moisture out of the food product. This liquid can be drawn out of the vacuum bag 14 through the open end 16 of the bag. The presence of this liquid/moisture on the interior surfaces of the open end 16 of the vacuum bag 14 can prevent or otherwise cause the sealing of the bag to fail, in which case the vacuum formed therein will not be maintained. As a result, the food product needs re-packaging, which wastes both time and money. Additionally, the failure may be slight and may go unnoticed, in which case the vacuum could fail slowly over time, causing the food product to spoil.

According to the invention, an apparatus 50 in the form of a liquid capture device prevents the passage of liquid to the open end 16 of the vacuum bag 14 while the vacuum is being formed, and thereby allows for forming a strong, air-tight seal of the bag in a consistent and repetitive manner. An example configuration of the liquid capture device 50 is illustrated in FIGS. 2A-2C.

Figures 2A, 2B, 2C:
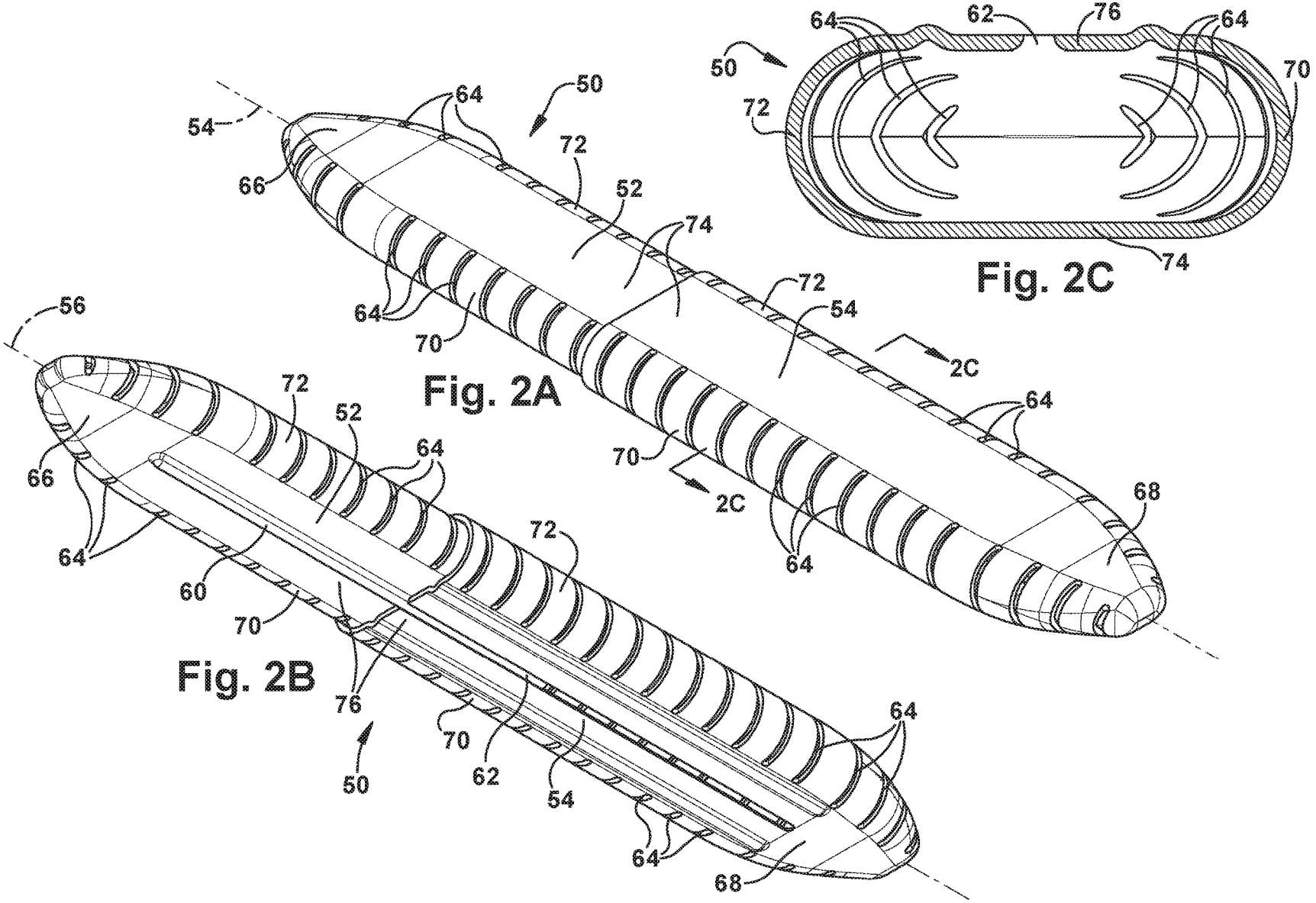
FIGS. 2A and 2B are perspective views illustrating an example configuration of the liquid capture apparatus of FIGS. 1A-1C.
FIG. 2C is a sectional view taken generally along line 2C-2C in FIG. 2A.

Referring to FIGS. 2A-2C, the liquid capture device 50 includes a structure in the form of a housing defined by inner and outer housing parts 52 and 54, respectively, that engage each other in a telescoping manner so as to slide relative to each other along a longitudinal axis 56. To facilitate this sliding engagement, the inner housing part 52 can have a longitudinal rib 60 that is received in a longitudinal slot 62 in the outer housing part 54. This telescoping configuration allows the overall length of the liquid capture device 50 to be adjusted to varying lengths between a minimum and maximum defined by the configuration and dimensions of the individual parts.

The liquid capture device 50 can be constructed out of any material suitable for use with food. The liquid capture device 50 can, for example, have a molded plastic construction. In one particular example, each of the housing parts 52, 54 can have a two-piece molded plastic construction in which the respective pieces snap together to form the part. The liquid capture device 50 has a generally flattened oval or oblong configuration when viewed in cross-section (see FIG. 2C). Opposite ends 66, 68 of the capture device 50 have generally tapered configurations. Each housing part 52, 54 includes a plurality of fluid capture slots 64 spaced along its length. The capture slots 64 extend vertically (as viewed in FIGS. 2A-2C) along side wall portions 70, 72 of the housing parts 52, 54, without extending into upper and lower wall portions 74, 76.

Figure 3:
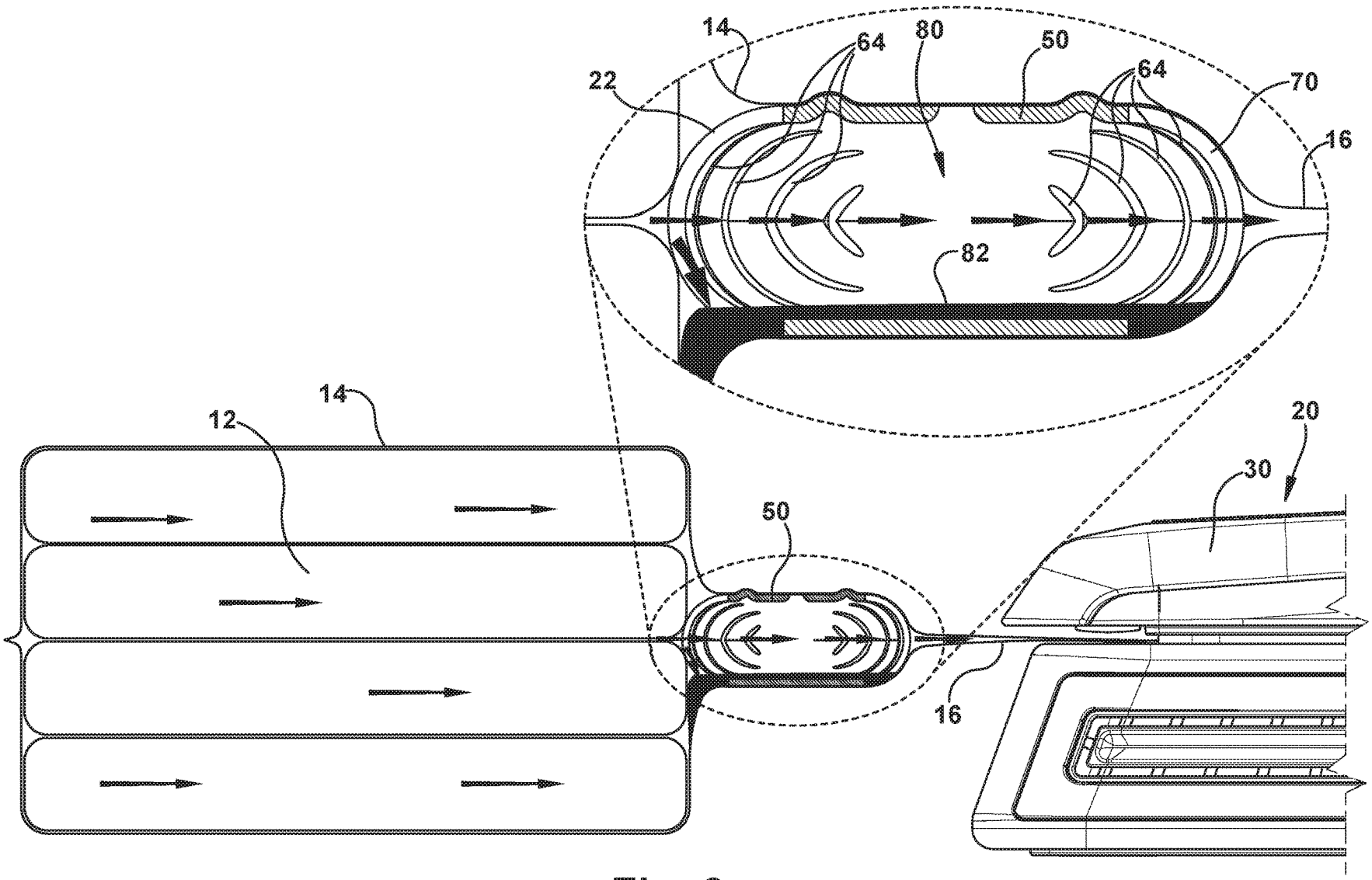
FIG. 3 is a schematic sectional view illustrating the operation of the liquid capture apparatus of FIGS. 1A-2C.

Referring to FIGS. 1B and 3, in operation, the liquid capture device 50 is implemented in the vacuum sealing system 10 to capture liquids drawn out of the food product 12 and prevent that liquid from entering the open end portion 16 of the vacuum bag 14. This prevents the liquid from compromising or otherwise interfering with the sealing of the bag 14 to produce the vacuum packaged food product. To use the liquid capture device 50, the housing parts 52, 54 are telescoped so the overall length of the device is commensurate with the width of the vacuum bag 14. The liquid capture device 50 is placed in the open end 16 of the vacuum bag 14, adjacent or near the food product 12 and spanning the width of the bag.

The end 16 of the bag 14 is then placed in the compartment 32 of the vacuum sealer 20 and the lid 30 is closed. The vacuum sealer 20 is operated in a normal, conventional manner and draws the air out of the vacuum bag 14. The air is drawn out of the vacuum bag 14, as illustrated generally by the arrows in FIGS. 1B and 3. As the air is removed from the bag 14, the bag is drawn in against the food product 12 and also against the liquid capture device 50. When this occurs, the bag 14 can squeeze the food product 12 and draw liquids, such as water and/or juices, out of the food product and toward the open end 16 of the bag.

When the air is removed from the vacuum bag 14 and the bag is drawn in against the liquid capture device 50, the capture device supports the bag against the vacuum formed in the bag. As a result, an open volume or reservoir 80 is formed inside the liquid capture device 50. The design and material construction of the liquid capture device 50 are selected such that the capture device can withstand the forces of the vacuum drawing the bag 14 against the housing parts 52, 54 and thereby maintain the reservoir 80 throughout vacuum formation and sealing of the open end 16 of the bag.

Referring to FIG. 3, as air and liquid are is drawn from the food product 12 and toward the open end 16 of the bag 14, both pass through the slots 64 in the side wall 72 proximate the food product 12 and into the reservoir 80 defined by the liquid capture device 50. The air passes through the reservoir 80, exiting through the slots 64 on the opposite side wall 70 proximate the open end 16 of the vacuum bag 14. Meanwhile, any liquid entering the reservoir 80 through the slots 64 in the side wall 72 is collected in the reservoir, as the effects of gravity cause the liquid to collect and pool 82 in the bottom of the reservoir as shown in FIG. 3. Advantageously, the vacuum bag 14, being drawn against the liquid capture device 50, blocks liquid from exiting the reservoir 80 through the slots 64 in the opposite side wall 70 of the device. As a result, the liquid capture device 50 permits air to be evacuated from the vacuum bag 14 while collecting liquids that are drawn from the food product 12.

Once the requisite vacuum is formed, the vacuum bag is sealed in the conventional manner, leaving the liquid capture device 50 sealed in the bag along with the food product 12. The liquid capture device 50 remains in the vacuum package until it is opened. Therefore, a liquid capture device 50 is required for every vacuum package. Advantageously, a two-piece molded plastic construction of the liquid capture device 50 relatively cheap, and the devices themselves are washable and reusable.

From the above, it will be appreciated that the overall shape and general configuration is not critical to the performance of the liquid capture device. The important features are that air and liquid can enter the device, air can pass through the device, and that the device provides a liquid reservoir that collects the liquid. The liquid capture device provides structural support that is strong enough to withstand the vacuum forces urging it to collapse, thereby maintaining the reservoir. Thus, it will be appreciated that the liquid collection device 50 can have alternative configurations.

Figure 4A:
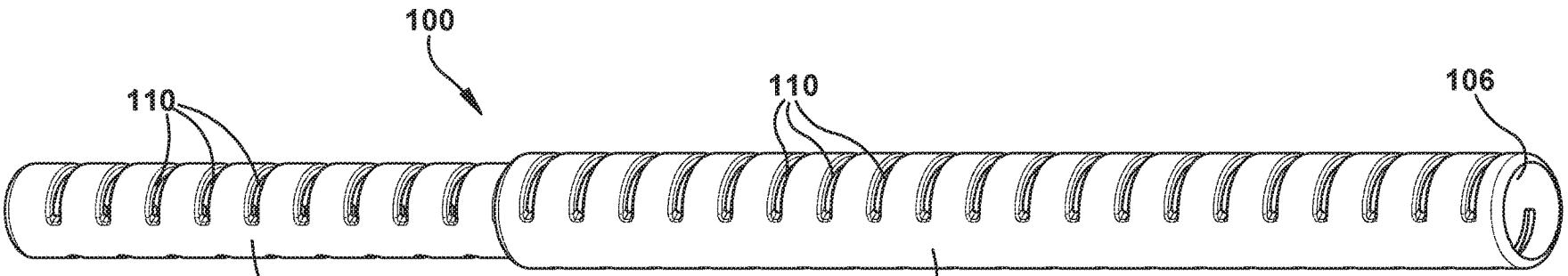
FIGS. 4A and 4B are perspective views illustrating a liquid capture apparatus for use with a vacuum sealer according to a second example embodiment.
Figure 4B:
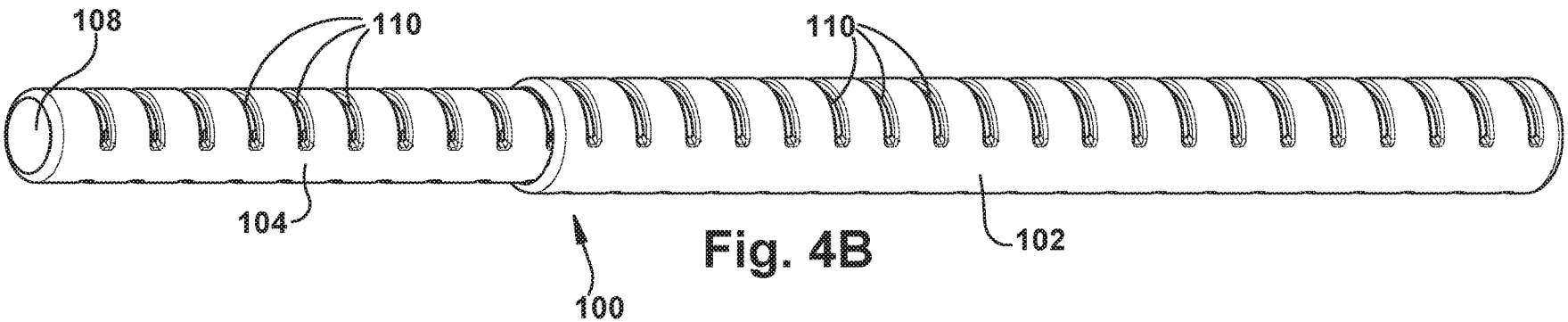

One example of an alternative configuration of the liquid collection device is illustrated in FIGS. 4A and 4B. In this example configuration, instead of the generally flattened oval or oblong cross-sectional configuration, the liquid collection device 100 in FIGS. 4A and 4B comprises a structure in the form of a housing that has a circular cross-sectional configuration. Accordingly, each of the telescoping housing parts 102, 104 has a generally cylindrical configuration each having a respective closed end wall 106, 108. Instead of having opposing slots, i.e., slots extending along opposing segments of the cylindrical side wall, single slots can extend circumferentially around each cylindrical housing portion, for example greater than 180 degrees or more, such as about 300 degrees or more. Slots 110 in the housing parts 102, 104 extend around their respective circumferences.

In operation, the liquid collection device 100 functions identically to the liquid collection device 50 described above and illustrated in FIGS. 1A-3. The liquid collection device 100 is telescoped to a length commensurate with the width of the vacuum bag in which it is being used. The device 100 is placed in the vacuum bag and the open end of the bag is placed in the vacuum sealer. As the vacuum is formed, liquids drawn out of the food product collect in the reservoir defined by the device and the surrounding vacuum bag. The bag is then sealed, producing the vacuum packaged food product.

Figure 5A:
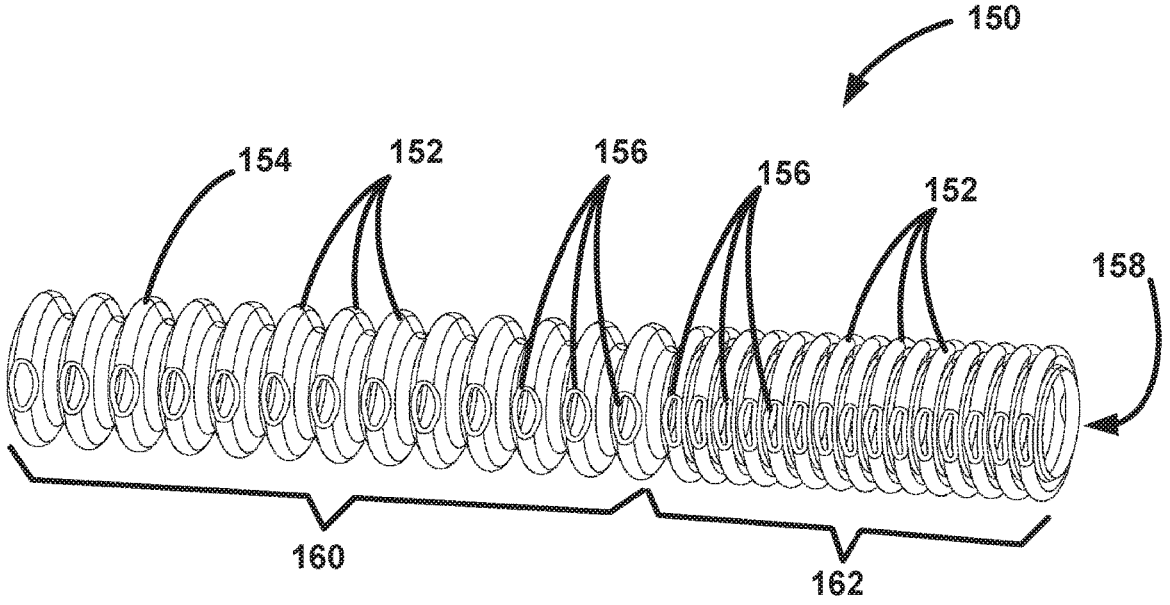
FIGS. 5A and 5B are perspective views illustrating a liquid capture apparatus for use with a vacuum sealer according to a third example embodiment.
Figure 5B:
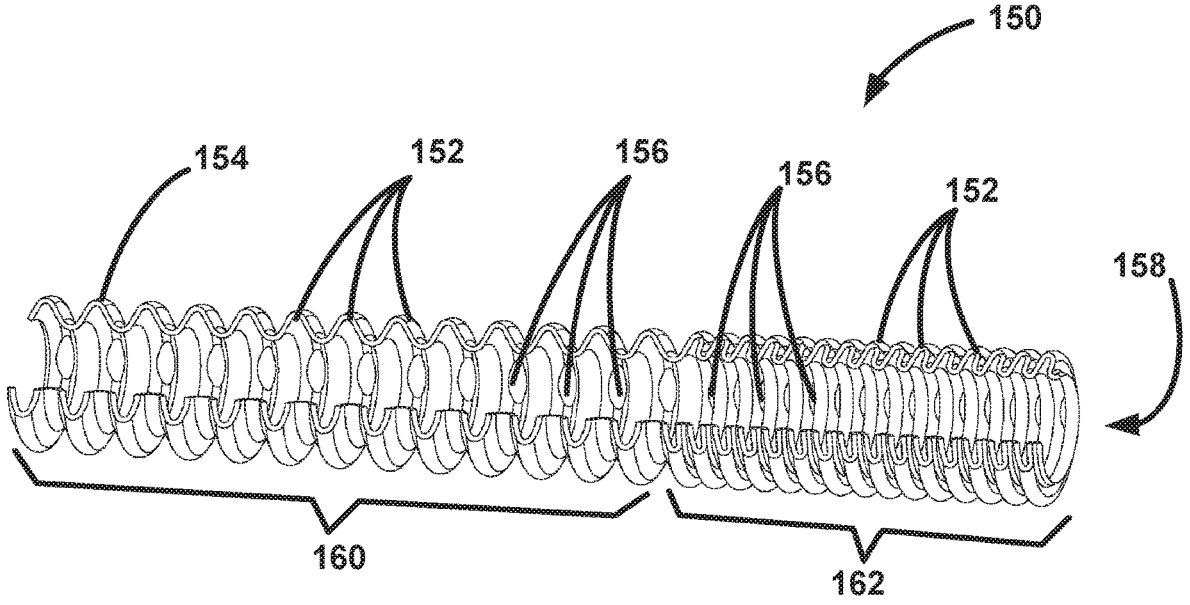

Another example of an alternative configuration of the liquid collection device is illustrated in FIGS. 5A and 5B. In this example configuration, instead of the telescoping rigid housing assemblies illustrated in FIGS. 1-4B, the liquid collection device 150 in FIGS. 5A and 5B has a unitary construction, i.e., it includes a single part. The liquid collection device 150 comprises a structure having a generally bellowed configuration with a circular cross-section. The liquid collection device 150 comprises a series of accordion-like bellow joints 152 that form a side wall 154 along its length and is similar in construction to bendable drinking straws and expansion joints used in plumbing applications. Slots or openings 156 in the side wall 154 provide fluid communication to an interior 158 of the liquid collection device 150 defined by the side wall. The liquid collection device 150 can be constructed of a variety of materials, such as food grade plastics.

Advantageously, this bellowed construction allows the overall length of the liquid collection device 150 to be adjusted. Much like a bellowed joint of a drinking straw, each bellow 152 of the liquid collection device 150 has a short length contracted condition and an extended length expanded condition. In FIGS. 5A and 5B, some of the bellow joints 152, indicated generally at 160, are expanded, and some of the bellow joints, indicated generally at 162, are contracted. The expanded/contracted condition of the bellow joints 152 is selectable individually and in any combination. The liquid collection device 150 thus can have an adjustable configuration in which the side wall 154 has a length that ranges from a minimum length in which all bellow joints 152 are contracted to a maximum length in which all bellow joints are expanded. The liquid collection device 150 can thus be used in vacuum bags having varying widths by adjusting its length through selecting the appropriate expanded/contracted condition of the bellow joints 152.

Additionally, each of the bellow joints 152 are deformable, allowing them to bend. The bellow joints can thus serve as bend joints, which allow the liquid collection device 150 not only to be adjusted lengthwise, but also to be bent or otherwise deformed to follow a non-linear path.

The liquid collection device 150 has a repetitive construction in which the bellow joints 152 are identical throughout its length. The length of the liquid collection device 150 is therefore easily customizable, depending on the application, i.e., vacuum bag size range. From this, it can be seen that the liquid collection device 150 can be constructed in a bulk length and then cut to the appropriate size.

In operation, the liquid collection device 150 functions in a manner similar or identical to that described above with respect to the embodiments of FIGS. 1-4B. The bellow joints 152 of the liquid collection device 150 are adjusted to a length commensurate with the width of the vacuum bag in which it is being used. The device 150 is placed in the vacuum bag and the open end of the bag is placed in the vacuum sealer. The liquid collection device 150 can also be bent or otherwise deformed to follow the contour of the product inside the vacuum bag. As the vacuum is formed, liquids drawn out of the food product collect in the reservoir defined by the device and the surrounding vacuum bag. The bag is then sealed, producing the vacuum packaged food product.

Figure 6A:
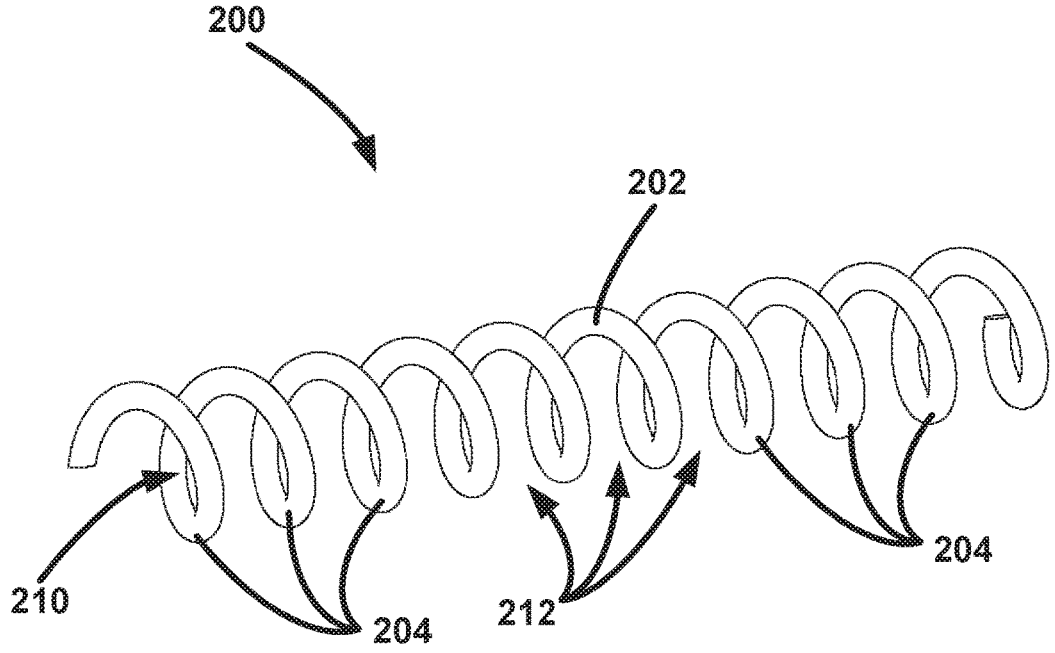
FIGS. 6A and 6B are perspective and plan views, respectively, illustrating a liquid capture apparatus for use with a vacuum sealer according to a fourth example embodiment.
Figure 6B:
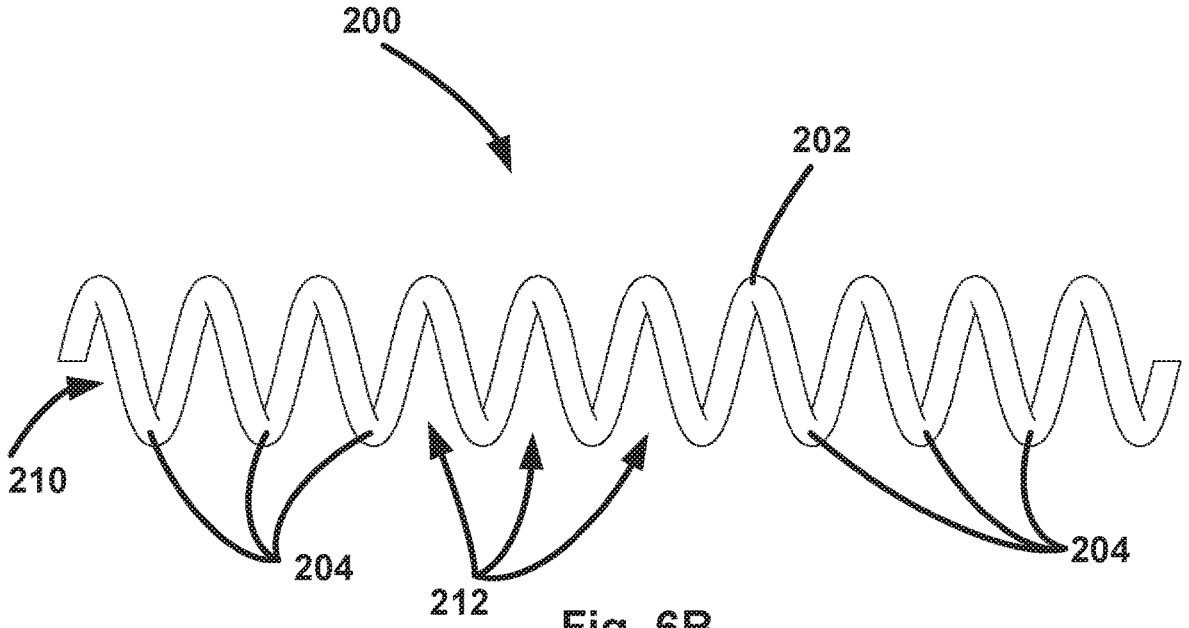

Another example of an alternative configuration of the liquid collection device is illustrated in FIGS. 6A and 6B. In this example configuration, instead of the telescoping rigid housing assemblies illustrated in FIGS. 1-4B, and the bellowed configuration illustrated in FIGS. 5A and 5B, the liquid collection device 200 in FIGS. 6A and 6B comprises a structure having a coiled configuration resembling a spiraled spring. In this configuration, the liquid collection device 200 is a single, unitary part having a helical configuration in which a helical coil element 202 includes a series of helical coil turns 204. The number of turns 202 determines the length of the liquid collection device 200. The liquid collection device 200 can be constructed of a variety of materials, such as food grade plastics. In the embodiment of FIGS. 6A and 6B, the coil element 202 has a circular cross-section.

Due to its helical construction, the liquid collection device 200 of FIGS. 6A and 6B does not require any slots or openings. The helical coil element 202 defines an interior space 210, fluid communication to which is provided by the spaces or openings 212 between the coil turns 204. Advantageously, this helical construction allows the overall length of the liquid collection device 200 to be adjusted. Due to its helical, spring like configuration, the helical turns 204 can be bent, deflected, or otherwise deformed to cause the length of the liquid collection device 200 to change. The helical coil element 202 can also be bent or otherwise deflected to follow a non-linear path.

The liquid collection device 200 has a repetitive construction in which the coil turns 204 can be identical throughout its length. The length of the liquid collection device 200 is therefore easily customizable, depending on the application, i.e., vacuum bag size range. From this, it can be seen that the liquid collection device 200 can be constructed in a bulk length and then cut to the appropriate size.

In operation, the liquid collection device 200 functions in a manner similar or identical to that described above with respect to the embodiments of FIGS. 1-5B. The helical coil element 202 of the liquid collection device 200 are adjusted to a length commensurate with the width of the vacuum bag in which it is being used. The device 200 is placed in the vacuum bag and the open end of the bag is placed in the vacuum sealer. The liquid collection device 200 can also be bent or otherwise deformed to follow the contour of the product inside the vacuum bag. As the vacuum is formed, liquids drawn out of the food product collect in the reservoir defined by the device and the surrounding vacuum bag. The bag is then sealed, producing the vacuum packaged food product.

Figure 7A:
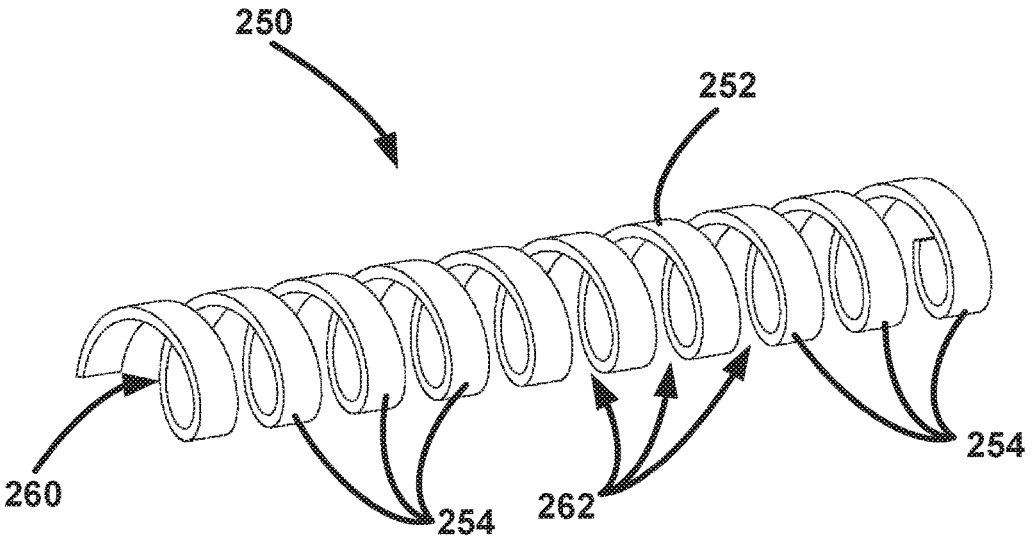
FIGS. 7A and 7B are perspective and plan views, respectively, illustrating a liquid capture apparatus for use with a vacuum sealer according to a fifth example embodiment.
Figure 7B:
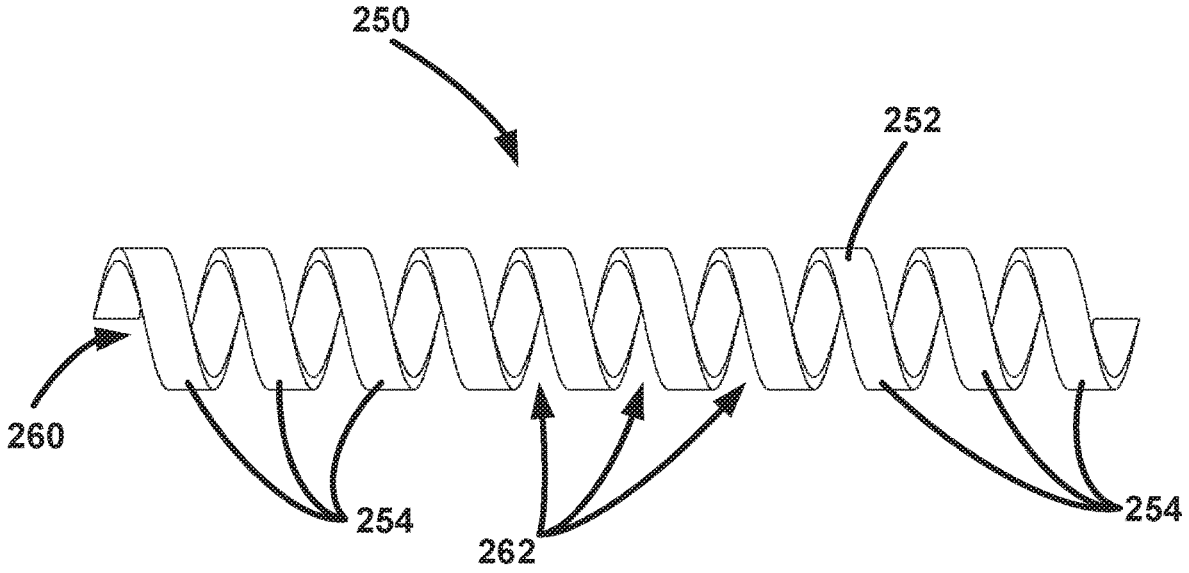

Another example of an alternative configuration of the liquid collection device is illustrated in FIGS. 7A and 7B. In this example configuration, the liquid collection device 250 comprises a structure having a coiled configuration similar to that of the liquid collection device 200 described and illustrated in FIGS. 6A and 6B. The only difference between these embodiments is that the helical coil element 252 of FIGS. 7A and 7B has a rectangular cross-sectional configuration, whereas the helical coil element 202 of FIGS. 6A and 6B has circular cross-sectional configuration. The rectangular cross-sectional configuration of the coil element 252 can help provide an improved or selectable/customizable degree of structural integrity of the device 250. The liquid collection device 250 of FIGS. 7A and 7B thus includes a series of helical coil turns 204, the number of which determines the length of the liquid collection device 250. The liquid collection device 250 can be constructed of a variety of materials, such as food grade plastics.

Due to its helical construction, the liquid collection device 250 of FIGS. 7A and 7B does not require any slots or openings. The helical coil element 252 defines an interior space 260, fluid communication to which is provided by the spaces or openings 262 between the coil turns 254. Advantageously, this helical construction allows the overall length of the liquid collection device 250 to be adjusted. Due to its helical, spring like configuration, the helical turns 254 can be bent, deflected, or otherwise deformed to cause the length of the liquid collection device 250 to change. The helical coil element 252 can also be bent or otherwise deflected to follow a non-linear path.

The liquid collection device 250 has a repetitive construction in which the coil turns 254 can be identical throughout its length. The length of the liquid collection device 250 is therefore easily customizable, depending on the application, i.e., vacuum bag size range. From this, it can be seen that the liquid collection device 250 can be constructed in a bulk length and then cut to the appropriate size.

In operation, the liquid collection device 250 functions essentially identically to the embodiment of FIGS. 6A and 6B. The helical coil element 252 of the liquid collection device 250 are adjusted to a length commensurate with the width of the vacuum bag in which it is being used. The device 250 is placed in the vacuum bag and the open end of the bag is placed in the vacuum sealer. The liquid collection device 250 can also be bent or otherwise deformed to follow the contour of the product inside the vacuum bag. As the vacuum is formed, liquids drawn out of the food product collect in the reservoir defined by the device and the surrounding vacuum bag. The bag is then sealed, producing the vacuum packaged food product.

From the above, it will be appreciated that the illustrated embodiments relate to a structure that defines an interior space and provides at least one opening configured so that air drawn out of the vacuum bag can pass through the structure, and liquid can enter the interior of the structure, but is prevented from escaping and thereby captured. While aspects of the present invention have been particularly shown and described with reference to the preferred embodiment above, it will be understood by those of ordinary skill in the art that various additional embodiments may be contemplated without departing from the spirit and scope of the present invention.

For example, while the liquid capture devices illustrated and described herein are shown as adjustable by telescoping, bending, stretching, deformation, etc., it will be appreciated that non-telescoping, fixed-length configurations are also possible. Since there are a finite number of vacuum bag sizes, these fixed-length liquid collection devices can be tailored for a specific bag size. This would further reduce the complexity of the design and reduce manufacturing steps in producing the device. For example, a fixed length liquid collection device could be manufactured as two molded plastic halves (split longitudinally) that snap together to produce the device.

Additionally, alternative shapes and configurations can also be envisioned. For example, helical structures that are elliptical or polygonal in cross-section are also possible. Other aspects, objects, and advantages of the present invention can be obtained from a study of the drawings, the disclosure, and the appended claims.

As a further alternative, any of the liquid collection/capture devices disclosed herein can be constructed of a hydrophilic polymer material. The hydrophilic polymer material is a polymer material with a chemical additive included during the molding process that changes the molecular composition of the polymer from a hydrophobic, i.e., liquid repelling, material to a hydrophilic material. The hydrophilic nature of the polymer material increases the attraction to the liquid drawn toward it in the vacuum sealing process, which thereby improves the collection of liquid in the interior chamber of the device.

In one particular example configuration, the liquid collection/capture device can be constructed of a thermoplastic polymer or polymer blend, such as those disclosed in U.S. Pat. No. 9,777,407 B2, issued to 3M Innovative Properties, Inc. on Oct. 3, 2017, the disclosure of which is hereby incorporated by reference in its entirety. The hydrophilic nature of these polymers causes them to have a strong affinity to water. As a result, water is attracted to the hydrophilic polymer and becomes mixed with, dissolved in, or wetted by water, which is referred to herein generally as absorbing water.

The liquid collection/capture device constructed of the hydrophilic polymer material is placed in the vacuum bag between the product and the open end of the bag being sealed. As the air is pulled from the bag during this vacuum sealing process, the liquid is drawn through the orifices to the interior chamber of the apparatus, where it is attracted to and absorbed by the hydrophilic polymer used to construct the device. Even when saturated, the device can still continue to collect liquids in the reservoir defined by the device housing. As a result, the device collects the liquid drawn toward the open end of the vacuum bag and prevents the liquid from entering the vacuum sealing area of the bag and the vacuum chamber of the vacuum sealer appliance.

The liquid collecting and/or capturing function of the device is improved through the use of the additives to the polymer, which imparts an ionic modification to the molecular structure of the polymer, which changes the device material from hydrophobic to hydrophilic. Placing the device between the open end of the vacuum bag to be sealed and the product in the bag, the hydrophilic material construction of the device improves its function as a liquid collection barrier that prevents liquid from entering the vacuum sealing of the bag and preventing a good vacuum seal.

We claim:

1. A method for vacuum packaging a product in a vacuum bag, comprising providing a liquid capture device for being positioned in an open end of the vacuum bag prior to drawing a vacuum in the vacuum bag, the liquid capture device comprising a reservoir for capturing liquid drawn from the product in response to the vacuum being drawn in the vacuum bag, wherein the liquid capture device has a length that can be adjusted to correspond to the width of the vacuum bag wherein providing a liquid capture device comprises:

providing inner and outer housing parts, the inner housing part being received in the outer housing part and retained in the outer housing part by a frictional engagement that permits telescoping sliding movement of the inner housing part relative to the outer housing part along an axis, the inner and outer housing parts when assembled forming an adjustable length housing structure that defines an open interior space comprising a reservoir for collecting liquid, wherein each of the inner and outer housing parts comprises axially extending outer walls that encircle the axis, an open end, and an opposite closed end;

inserting the open end of the inner housing part into the open end of the outer housing part such that the outer walls of the inner and outer housing parts defining an outer wall of the liquid capture device, and the closed ends of the inner and outer housing parts define opposite ends of the liquid capture device;

providing a plurality of openings in the outer walls of both the inner and outer housing parts that provide fluid communication between the interior space and the environment outside the housing structure, wherein the plurality of openings are configured so that air drawn out of the vacuum bag can pass through the structure via the at least one opening and exit the vacuum bag through the open end, and liquid can enter the interior of the structure, but is prevented from escaping and thereby captured.

2. The method recited in claim 1, wherein providing a liquid capture device comprises providing a structure that defines an interior space including the reservoir, and providing at least one opening that extends through the structure and provides fluid communication between the interior space and the environment outside the structure, wherein the at least one opening is configured so that air drawn out of the vacuum bag can pass through the structure via the at least one opening and exit the vacuum bag through the open end, and liquid can enter the interior space of the structure and be captured in the reservoir, but is prevented from escaping and thereby captured.

3. The method recited in claim 2, wherein providing a structure further comprises providing a housing comprising a side wall that defines the interior space, the at least one opening extending through the side wall.

4. The method recited in claim 2, wherein providing a structure further comprises providing a housing comprising first and second housing parts connected to each other in a telescoping relationship so that the length of the housing can be adjusted.

5. The method recited in claim 2, wherein providing a structure further comprises providing a housing comprising having a generally flattened oval or oblong cross-sectional configuration.

6. The method recited in claim 2, wherein providing a structure further comprises providing a housing comprising having a generally flattened oval or circular cross-sectional configuration.

7. A method for vacuum packaging a product in a vacuum bag, comprising providing a liquid capture device for being positioned in an open end of the vacuum bag prior to drawing a vacuum in the vacuum bag, the liquid capture device comprising a reservoir for capturing liquid drawn from the product in response to the vacuum being drawn in the vacuum bag, wherein providing a liquid capture device comprises:

providing inner and outer housing parts, the inner housing part being received in the outer housing part and retained in the outer housing part by a frictional engagement that permits telescoping sliding movement of the inner housing part relative to the outer housing part along an axis, the inner and outer housing parts when assembled forming an adjustable length housing structure that defines an open interior space comprising a reservoir for collecting liquid, wherein each of the inner and outer housing parts comprises axially extending outer walls that encircle the axis, an open end, and an opposite closed end;

inserting the open end of the inner housing part into the open end of the outer housing part such that the outer walls of the inner and outer housing parts defining an outer wall of the liquid capture device, and the closed ends of the inner and outer housing parts define opposite ends of the liquid capture device;

providing a plurality of openings in the outer walls of both the inner and outer housing parts that provide fluid communication between the interior space and the environment outside the housing structure, wherein the plurality of openings are configured so that air drawn out of the vacuum bag can pass through the structure via the at least one opening and exit the vacuum bag through the open end, and liquid can enter the interior of the structure, but is prevented from escaping and thereby captured.

8. The method recited in claim 7, wherein providing a liquid capture device further comprises providing a liquid capture device that is free from any additional structure within the open interior space of the housing structure.

9. The method recited in claim 7, wherein providing a liquid capture device comprises providing a liquid capture device that consists only of the inner housing part and the outer housing part.

10. The method recited in claim 7, wherein the outer wall of the liquid capture device comprises an upper wall, a lower wall, and opposite side walls that extend between the upper and lower walls, wherein the lower wall and portions of the side walls where the lower wall and side walls meet define the reservoir.

11. The method recited in claim 10, further comprising:

configuring the upper and lower wall portions to be positioned adjacent opposite plies of the vacuum bag;

configuring a first one of the side walls is configured to be positioned proximate the product in the vacuum bag, and configuring the other one of the side walls to be positioned proximate the open end of the vacuum bag;

configuring the relative positions of the inner and outer housing parts to adjust axially so that the length of the liquid capture device is about equal to the width of the open end of the vacuum bag; and configuring the closed ends of the inner and outer housing parts to be tapered so as to be accommodated in the space of the vacuum bag where the opposite plies meet.

12. The method recited in claim 7, wherein the openings comprise narrow vertically extending slits in the side walls.

13. The method recited in claim 7, wherein the upper and lower walls are generally flat and the side walls are rounded and extend concavely outward.

14. The method recited in claim 7, further comprising configuring the inner housing part to include a longitudinal rib on an exterior surface that engages a longitudinal slot on an interior surface of the outer housing part.

15. The method recited in claim 7, further comprising configuring the closed ends of the inner and outer housing parts to have a tapered configuration.

16. The method recited in claim 7, further comprising configuring the outer wall of the liquid capture device is cylindrical.

17. The method recited in claim 7, further comprising configuring the outer wall of the liquid capture device to have one of a generally flattened oval cross-sectional configuration, a generally flattened oblong cross-sectional configuration, a generally circular cross-sectional configuration, and a bellowed configuration.

* * * * *